US010226848B2

(12) United States Patent
Meirelles Tomanik et al.

(10) Patent No.: US 10,226,848 B2
(45) Date of Patent: Mar. 12, 2019

(54) METHOD FOR THE TRIBOMECHANICAL CONDITIONING OF A THIN-WALLED CYLINDER/LINER, AND CYLINDER LINER

(71) Applicants: Mahle Metal Leve S/A, Jundiai (BR); Mahle International GmbH, Stuttgart (DE); Applied Nano Surfaces Sweden AB, Uppsala (SE)

(72) Inventors: Antonio Eduardo Meirelles Tomanik, Sao Paulo (BR); Boris Zhmud, Uppsala (SE); Christian Kolar, Uppsala (SE); Mattias Granlund, Uppsala (SE)

(73) Assignees: Mahle Mental Leve S/A (BR); Mahle International GmbH (DE); Applied Nano Surfaces Sweden AB (SE)

( * ) Notice: Subject to any disclaimer, the term of this patent is extended or adjusted under 35 U.S.C. 154(b) by 187 days.

(21) Appl. No.: 15/039,793

(22) PCT Filed: Nov. 13, 2014

(86) PCT No.: PCT/EP2014/074513
§ 371 (c)(1),
(2) Date: May 26, 2016

(87) PCT Pub. No.: WO2015/078702
PCT Pub. Date: Jun. 4, 2015

(65) Prior Publication Data

US 2016/0375537 A1 Dec. 29, 2016

(30) Foreign Application Priority Data

Nov. 27, 2013 (BR) ..... 10 2013 030435 2

(51) Int. Cl.
*B24B 1/00* (2006.01)

(52) U.S. Cl.
CPC ..... *B24B 1/00* (2013.01)

(58) Field of Classification Search
CPC ..... B24B 1/00
See application file for complete search history.

(56) References Cited

U.S. PATENT DOCUMENTS

| | | | |
|---|---|---|---|
| 8,545,930 | B2 | 10/2013 | Stavlid |
| 8,839,514 | B2 | 9/2014 | Scharf |
| 2003/0192501 | A1 | 10/2003 | Ishikawa et al. |

FOREIGN PATENT DOCUMENTS

| | | | |
|---|---|---|---|
| CN | 101918612 | A | 12/2010 |
| CN | 103097578 | A | 5/2013 |
| EP | 2229467 | A2 | 9/2010 |
| EP | 2441549 | A2 | 4/2012 |
| WO | WO-2009071674 | A2 | 6/2009 |
| WO | WO-2012/008890 | A1 | 1/2012 |

OTHER PUBLICATIONS

Chinese Office Action dated Feb. 4, 2017 relating to corresponding Chinese Patent Application No. 201480062901.1.

*Primary Examiner* — Ryan J. Walters
(74) *Attorney, Agent, or Firm* — Fishman Stewart PLLC

(57) ABSTRACT

The present invention relates to a method for the lining of a thin-walled sliding element (20) for internal combustion engine blocks ion which: (i) the pressure applied for honing the sliding element (20) is between 8 MPa and 9 MPa; and (ii) at least a part of the inner surface (21) of the sliding element (20) comprises a nano-coat of solid lubricant provided with roughnesses, before honing, of Rpk, Rk and Rvk no lower than ⅔ of the original.

7 Claims, 3 Drawing Sheets

METHOD FOR THE TRIBOMECHANICAL CONDITIONING OF A THIN-WALLED CYLINDER/LINER, AND CYLINDER LINER

CROSS-REFERENCE TO RELATED APPLICATIONS

This application claims priority to Brazilian Patent Application No. 10 2013 030435 2, filed Nov. 27, 2013, and International Patent Application No. PCT/EP2014/074513, filed Nov. 13, 2014, both of which are hereby incorporated by reference in their entirety.

TECHNICAL FIELD

The present invention relates to a method for the tribomechanical conditioning of a thin-walled conditioning of a thin-walled cylinder/liner for use in particular in an internal combustion engine block.

BACKGROUND

There is currently a growing demand for engine materials and/or components which offer greater wear resistance and reduced friction. With respect to the automotive sector, and more specifically the lining and/or treatment of surfaces of combustion engine cylinders/bores, recent research has been developed with a view to obtaining surface materials and finishes which contribute to a reduction in fuel consumption, and consequently CO2 emissions, through reduced losses due to friction. Solutions involving nanotechnology have been the particular focus of recent research.

A possible solution is described in the patent document EP 2 229 467 which describes a method for manufacturing a mechanical element, such as an engine component, which has a surface of reduced friction which has a tribochemical conditioning/deposition of a substance such as a solid lubricant, which covers the surface of the element.

Patent document CA 2 704 078 is very similar to the above European document and relates to the process for manufacturing a low friction element by tribochemically conditioning a solid lubricant, specifying the application of the solid lubricant to an engine cylinder liner.

Finally, patent document US 2010/0272942, of the same family of both of the above-mentioned documents, relates to a similar manufacturing process, with the emphasis on its use in cylinder liners and engine block cylinders.

The three patent documents mentioned relate to a dedicated metal mechanical process which combines the extreme mechanical pressure of honing the surface of the component with the tribochemical or mechanicochemical deposition of the anti-wear film of low friction tungsten disulphate (WS2).

Despite the advantages of reducing friction and wear in liners/cylinder, the extreme pressure applied during the tribomechanical conditioning used in the above-mentioned technique, may deform the liner/cylinder from its ideal circular shape in the thin-walled blocks normally used in low weight engine blocks. To prevent the increase in the consumption of lubricating oil in the aforementioned bore/cylinder of deformed engine blocks, use must be made of piston rings with higher forces, which jeopardises the reduction in friction.

With a view to minimising the above-mentioned reduction in friction when piston rings with a higher load is used, the original roughness of the bore/cylinder of the blocks may be reduced, which may not be desirable. This is due to the fact that some degree of roughness is desirable since the roughness may serve as a lubricating oil reservoir, thus enabling the parts, the piston rig and block bore/cylinder, soften in the first few hours of operation of the engine.

For the purpose of overcoming such limitations, the inventors have developed an improved tribomechanical conditioning process by using low pressure during the honing process yet still achieving a significant reduction in friction according to the description below.

SUMMARY

The objective of the present invention is to provide a method for the tribomechanical conditioning of a thin-walled sliding element for internal combustion engine blocks to ensure a reduction in the fuel consumption of the engine and low deformation of the same.

The objectives of the invention are achieved by a method for the tribomechanical conditioning of a thin-walled liner/cylinder for internal combustion engine blocks in which:

(i) the pressure applied for honing the sliding element is between 5 MP and 15 MPa; and (ii) at least part of the inner surface of the sliding element, comprises a nano-coat of solid lubricant, provided with roughnesses, before honing, of Rpk, Rk and Rvk no lower than ⅔ of the original.

BRIEF DESCRIPTION OF THE DRAWINGS

The present invention will be described in more detail on the basis of embodiments shown in the drawings. In the figures.

DETAILED DESCRIPTION

Figure 1:
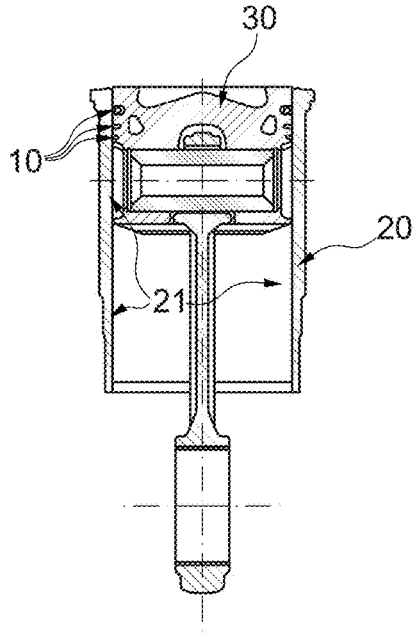
FIG. 1 shows a schematic view of the sliding element for use in an internal combustion engine covered by this invention.

As described in the description of the state of the art, a tungsten disulphide (WS) lining for minimising the reduction in friction between the tribo system, piston rings 10, liner/cylinder 20 and piston 3, and tribomechanical conditioning by honing, are already known, but this solution, which impacts the oil/gas seal of the tribo system referred to due to possible deformations if the cylinder has thin walls, between 1.6 mm and 5 mm.

This invention eliminates the problem referred to by using a low pressure, high speed honing process which provides a surface adequate for reducing friction whilst at the same time providing a low/reduced deformation of a thin-walled sliding element 20. It is worth mentioning that the sliding element 20 referred to may be a cylinder liner or even an engine block cylinder/bore.

It should be noted that the process makes it possible to work at a lower pressure sine longer tools have been created and even having a slightly slower process is compensated for by the lower pressure. It should also be noted that if the same length of tool were to be used in the tribomechanical conditioning process, the process time would be 50% longer with this configuration. Even with a longer process time the surface will still have sufficient roughnesses in contact with the others, between the tool and the part, to form the tribo film and obtain an improvement in the roughness of the surface.

Table I below demonstrates the roughness values found before and after said process, where it is observed that unlike in the state of the art documents, the roughness is slightly reduced.

TABLE I

| Pre- and post-treatment roughnesses | | |
|---|---|---|
| | Original | After process |
| Rpk | 0.13 | 0.10 |
| Rk | 0.53 | 0.48 |
| Rvk | 1.81 | 1.86 |

Table II shows the characteristics of the test used for confirming the low pressure treatment.

TABLE II

| Characteristics of the Floating Liner test | |
|---|---|
| Type of engine | Single cylinder, 4-stroke SI |
| Displacement (litres) | 0.65 |
| Diameter × stroke (mm | 96 × 89.2 |
| Compression Rate | 9.7 |
| Operating Conditions (Speed and IMEP) | 1300 rpm @ 0.53 MPa 5.3 bars, 0.83 MPa (8.3 bars) 2500 rpm @ 0.63 MPa (6.3 bars), 0.93 MPa (9.3 bars) |

Figure 2:
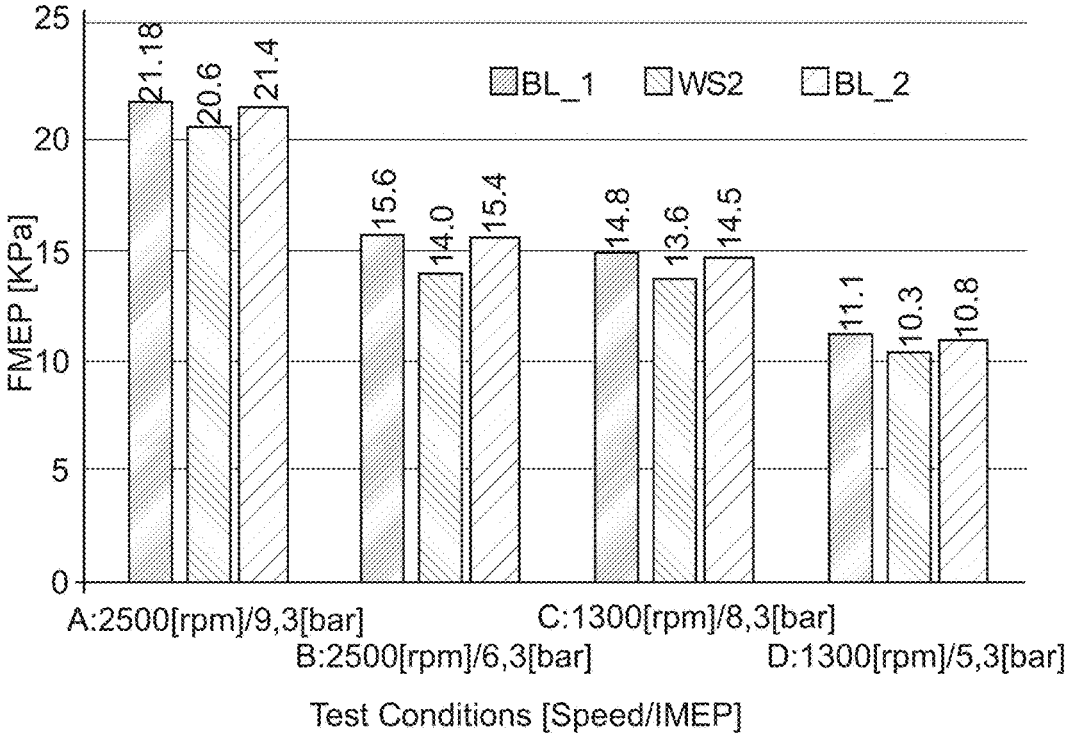
FIG. 2 shows the result of FMEP measurement (comparative test) between the standard cylinder (base or baseline) and the cylinder with tribomechanical condition.

FIG. 2 shows the friction mean effective pressure (FMEP) measurement in each regime. The liner with tribomechanical conditioning (b) had a FMEP reduction of 5 to 11%. For repetition, the standard liner (baseline—a) also showed a reduction, but much smaller compared to the sliding element 20 with tribomechanical conditioning (b). The small FMEP reduction in the repetition of standard liner (baseline—a) is due to the fact that there is a transfer from the tribological layer of the lining to the rings and to the piston chamber. This hypothesis will be investigated in future tests. The fuel saving in each operating condition may be estimated as (Δ FMEP/IMEP), which would give a fuel saving of 0.13-0.27%.

Figure 3:
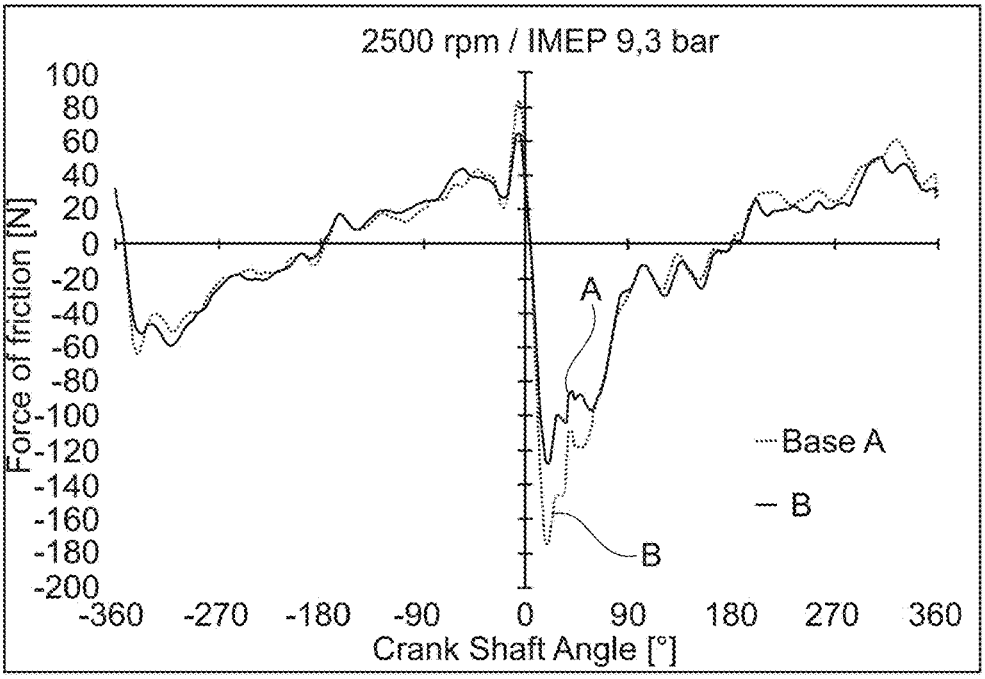
FIG. 3 shows the result of the comparative test between the standard liner (base or baseline) and the liner with tribomechanical conditioning under the force of friction and combustion pressure at 2500 rpm at 0.93 MPa (9.3 bars).

The floating liner test enables the frictional forces along the stroke to be resolved. FIG. 3 shows a comparison between the standard liner (base/baseline—a) and liner 20 with tribomechanical conditioning (b) under the condition of frictional force and fuel pressure at 2500 rpm at 0.93 MPa (9.3 bars), where the force is measured along the travel of the crank. As expected, major reductions in friction occurred in the course of expansion, particularly loss of the upper point of reversal, where the fuel pressures are highest and the speeds lowest, which leads to a boundary lubrication regime.

Figure 4:
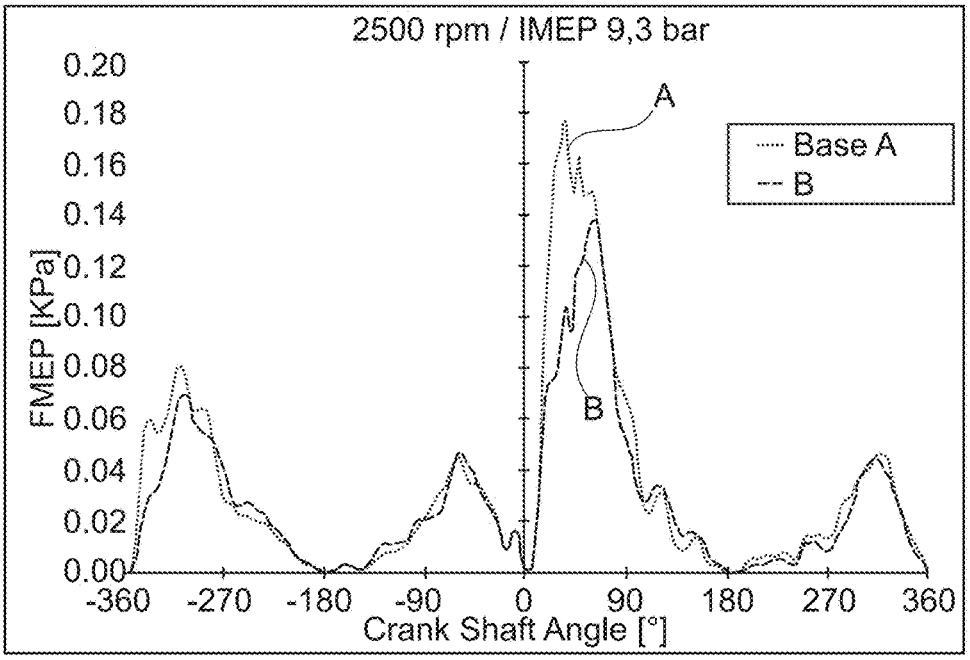
FIG. 4 shows the result of the comparative test for loss due to friction between the standard liner (base o baseline) and the liner with tribomechanical conditioning.

In terms of fuel saving, the losses by friction are more important than the forces of attrition. FIG. 4 shows the instantaneous FMEP at each angle of the crankshaft. It is possible to establish from FIG. 4 that the greatest FMEP reductions occurred between the angles of 20° and 60°, but in practice this occurs throughout the piston stroke. As discussed in the reciprocal tests, the tribo layer (b) appears to have a beneficial effect, even under conditions where the speeds are highest and the lubrication regime has a hydrodynamic tendency.

Figure 5:
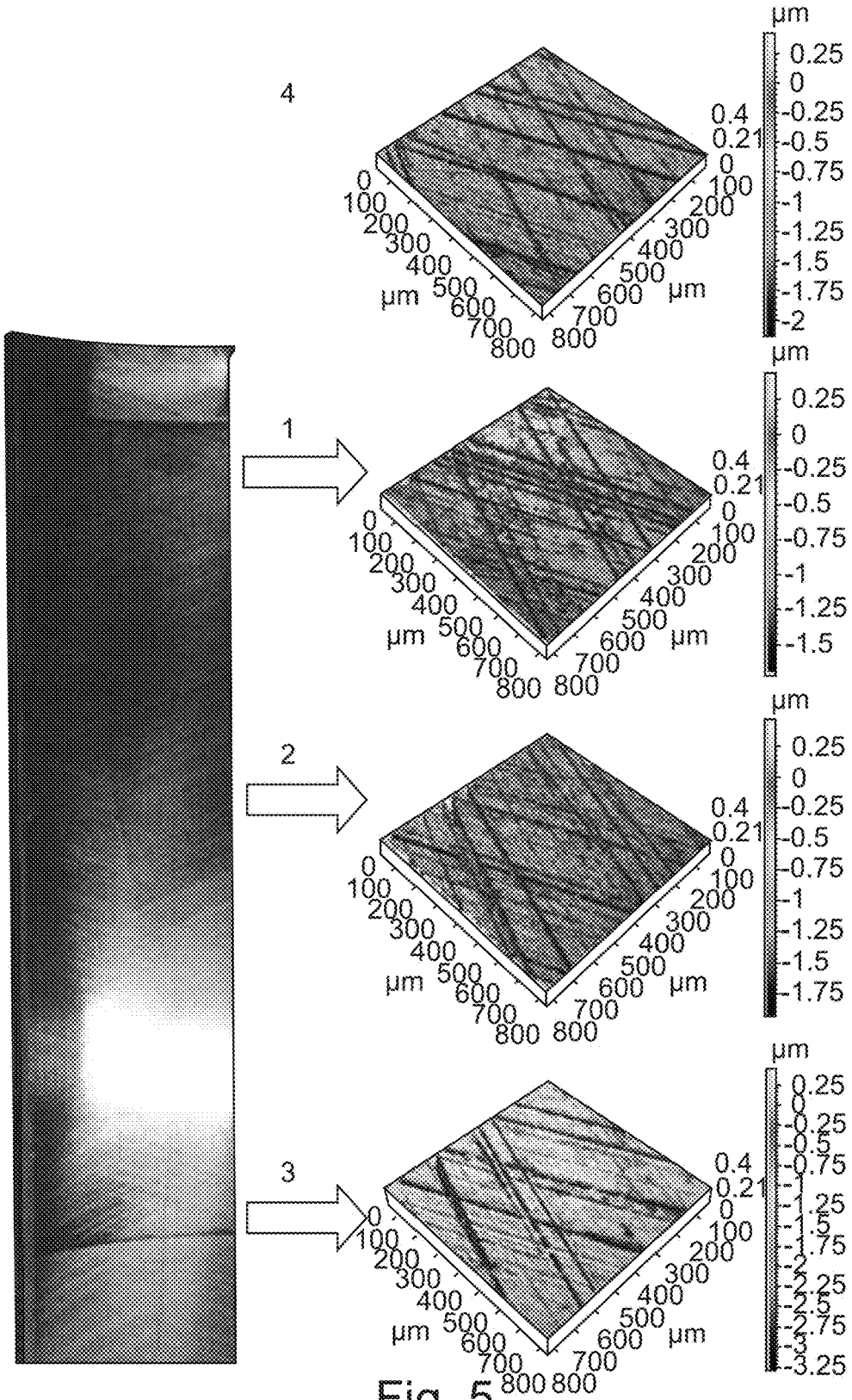
FIG. 5 shows a schematic view of the thin-walled liner sliding element for use in an internal combustion engine covered by this invention, as tested in an engine with a floating liner.

After the test liner 20 with tribomechanical conditioning (b) was cut and its topography measured n three positions 1, 2, 3 along the stroke of the rings. As can be seen in FIG. 5, the lower region 3, outside the piston stroke, was assumed to be representative of the new condition. In mid strike 2, the topography was found to be almost unaltered. It was therefore concluded that the tribo layer was preserved, which would allow the preservation/maintenance of the reduction in friction. At the points of reversal, as expected, greater wear was found, which demonstrates that the tribo layer could have been removed, but although the forces of friction are high at the points of inversion, the speeds are low and there are even losses due to friction.

Table III shows the different values of the roughnesses found in regions 1, 2 and 3 in FIG. 5.

TABLE III

| Roughnesses after test | | | |
|---|---|---|---|
| | 1 | 2 | 3 |
| Rpk | 0.07 | 0.09 | 0.14 |
| Rk | 022 | 0.45 | 0.26 |
| Rvk | 0.66 | 0.90 | 1.3 |

In addition, after microscopic analysis of liners 20, with tribomechanical conditioning (b), it was possible to observe the presence of tungsten on the surface.

The invention therefore relates to a sliding element obtained by the method just defined.

Now that preferred embodiments have now been described, it should be understood that the scope of the present invention extends to other possible variations limited only by the content of the attached claims, which include the possible equivalents.

The invention claimed is:

1. A Method for the tribomechanical conditioning of thin-walled sliding elements for an internal combustion engine block, comprising:

providing a sliding element having a surface to be conditioned defining an original roughness;

honing the surface to be conditioned of the sliding element to form a conditioned surface comprising a nanolayer of solid lubricant;

wherein honing the surface to be conditioned of the sliding element is performed with an applied pressure between 5 MPa and 15 MPa and provides the conditioned surface comprising the nanolayer of solid lubricant with a roughness of Rpk, Rk, and Rvk that is no less than ⅔ of the original roughness of the surface to be conditioned.

2. The method of claim 1, wherein the sliding element has a wall thickness between 1.6 mm and 5 mm.

3. The method of claim 1, wherein the nanolayer of solid lubricant includes tungsten disulphide.

4. The method of claim 1, wherein the sliding element is a cylinder liner.

5. The method of claim 1, wherein the sliding element is an engine block cylinder.

6. The method of claim 1, wherein the original roughness of the surface to be conditioned is Rpk of 0.13, Rk of 0.53, and Rvk of 1.18.

7. The method of claim 1, wherein the sliding element is a thin-walled metal cylinder liner or a thin-walled metal engine block cylinder respectively having a wall thickness of between 1.6 mm and 5 mm.

* * * * *